US005140774A

United States Patent [19]

Onodera

[11] Patent Number: 5,140,774

[45] Date of Patent: Aug. 25, 1992

[54] APPARATUS FOR POLISHING HARD DISK SUBSTRATES

[75] Inventor: Masami Onodera, Niigata, Japan

[73] Assignee: System Seiko Co., Ltd., Niigata, Japan

[21] Appl. No.: 785,974

[22] Filed: Oct. 31, 1991

[51] Int. Cl.[5] ..... B24B 7/04; B24B 29/00

[52] U.S. Cl. ..... 51/134; 51/133; 51/215 AR; 51/215 UE; 51/240 T; 51/118; 198/345.2; 198/476.1

[58] Field of Search ..... 51/237 T, 109 R, 117, 51/118, 131.1, 131.3, 132, 133, 134, 215 A, 215 R, 215 UE, 215 CP, 240 A, 240 T; 198/345.2, 476.1

[56] References Cited

U.S. PATENT DOCUMENTS

| | | | |
|---|---|---|---|
| 1,361,883 | 12/1920 | Littman | 51/237 T |
| 1,833,329 | 11/1931 | Packer | 51/108 R |
| 1,989,517 | 1/1935 | Holmes | 51/134 |
| 3,115,091 | 12/1963 | Hakogi | 198/476.1 |
| 4,593,496 | 6/1986 | Klievoneit et al. | 51/118 |
| 4,856,232 | 8/1989 | Shirai | 51/118 |

FOREIGN PATENT DOCUMENTS

| | | | |
|---|---|---|---|
| 0144654 | 9/1982 | Japan | 51/118 |
| 0207559 | 8/1988 | Japan | 51/132 |

OTHER PUBLICATIONS

"Disk Substrate Polisher"; Fox et al IBM Technical Disclosure Bulletin vol 26, No. 3B, Aug. 1983.

*Primary Examiner*—Robert A. Rose

*Attorney, Agent, or Firm*—Lowe, Price, LeBlanc & Becker

[57] ABSTRACT

An apparatus capable of simultaneously polishing a plurality of hard disk substrates at the same time includes at least three substrate carriers which are rotatably disposed on an index table and which carry and transfer a plurality of hard disk substrates, are moved successively through a substrate loading station, a substrate polishing station and a substrate removing station in response to intermittent rotation of the index table.

6 Claims, 3 Drawing Sheets

APPARATUS FOR POLISHING HARD DISK SUBSTRATES

BACKGROUND OF THE INVENTION

1. Field of the Invention

The present invention relates to an apparatus for polishing the substrate of a hard disk used in electronic equipment such as computers.

2. Description of the Prior Art

In recent years, with the increasing tendency to use a hard disk drives as an auxiliary storage for electronic devices such as computers, the demand to be able to produce hard disk drives quickly and economically has increased. As is well known, the substrate of a hard disk (hereinafter occasionally referred to, for brevity, as "substrate") must be polished before a magnetic material can be coated on the opposite sides thereof.

In a substrate polishing machine used heretofore, a single substrate is fed into a polishing station and both faces or sides are polished at the same time. Following this operation the polished substrate is removed from the polishing station, and the next substrate is fed thereinto. However, as the substrates are polished one by one, the prior polishing process tends to be slow and time-consuming.

Furthermore, the prior substrate polishing machine is constructed to support the substrate in a horizontal position and polish the faces from above and below. This tend to induce the problem that the upper and lower surface of the substrate are not polished evenly.

SUMMARY OF THE INVENTION

In view of the above mentioned drawbacks, it is an object of the present invention to provide an apparatus which enables a number of hard disk substrates to be polished at the same time.

Another object of the present invention is to provide an apparatus which is capable of polishing opposite sides of a hard disk substrate with highly accurate uniformity.

In brief, an apparatus capable of simultaneously polishing a plurality of hard disk substrates at the same time includes at least three substrate carriers which are rotatably disposed on an index table and which carry and transfer a plurality of hard disk substrates, are moved successively through a substrate loading station, a substrate polishing station and a substrate removing station in response to intermittent rotation of the index table.

More specifically, an aspect of the present invention is deemed to come in an apparatus for polishing hard disk substrates, comprising: an index table intermittently rotatable about a first axis; and at least three substrate carriers each rotatably supported on the index table so as to be rotatable about a second axis, each of said substrate carriers being so constructed and arranged as to support a plurality of hard disk substrates, said index table being rotatable to move said substrate carriers successively through a substrate mounting station in which a plurality of hard disk substrates are mounted on said substrate carriers, a substrate polishing station in which a plurality of hard disk substrates supported on said substrate carriers are polished, and a substrate removing station in which a plurality of polished hard disk substrates are removed from said substrate carriers The above and other objects, features and advantages of the present invention will become more apparent from the following description when making reference to the detailed description and the accompanying sheets of drawings in which a preferred structural embodiment incorporating the principles of the present invention is shown by way of illustrative examples.

DETAILED DESCRIPTION OF THE INVENTION

The invention will be described below in greater detail with reference a preferred embodiment illustrated in FIGS. 1-3.

Figure 1:
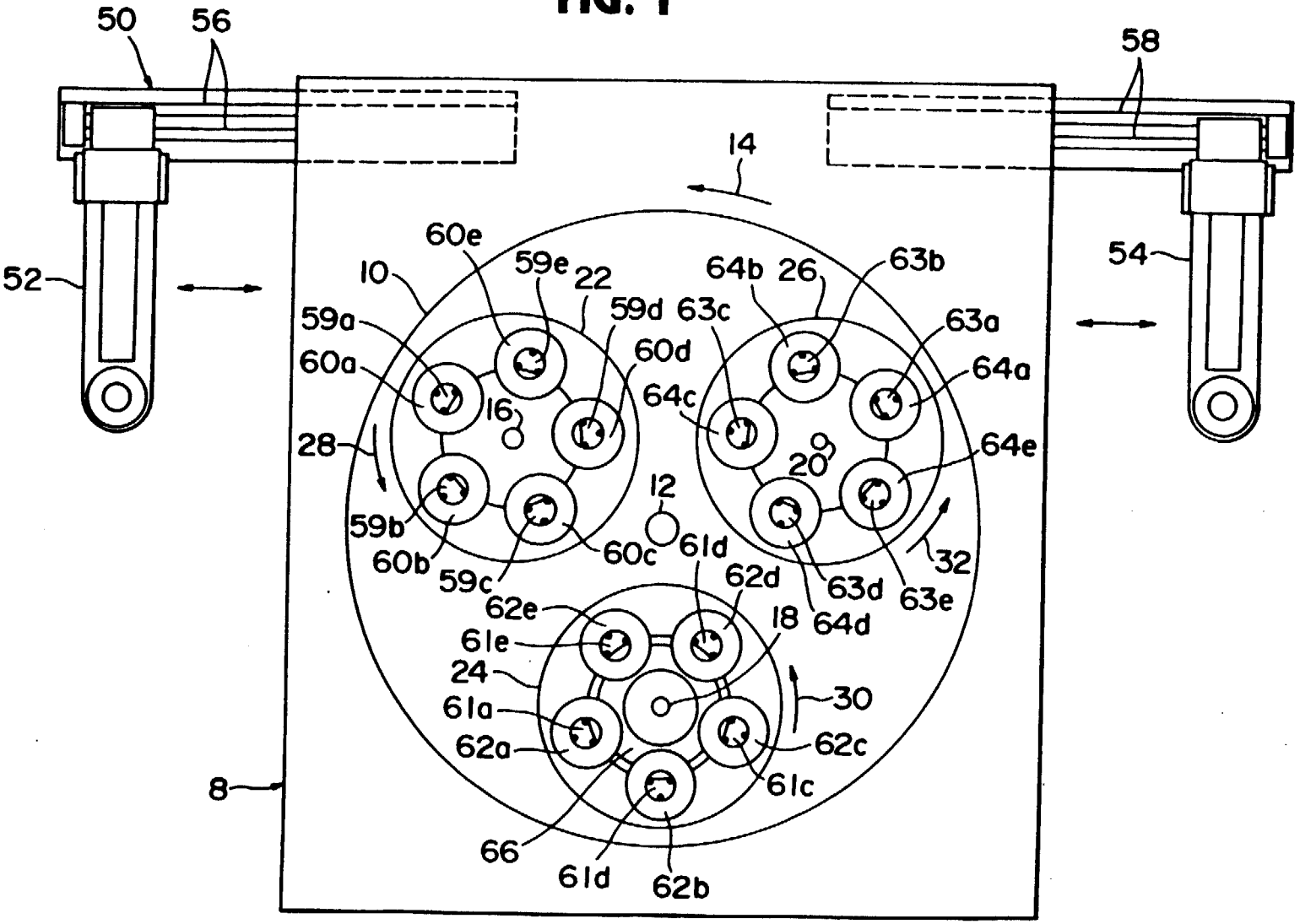
FIG. 1 is a front elevational view of an apparatus for polishing hard disk substrates according to the present invention.

FIG. 1 shows the general arrangement of a hard disk substrate polishing apparatus according to this invention. The apparatus includes an index table 10 which is intermittently rotatable about a shaft 12 in the direction of the arrow 14 shown in FIG. 1.

It is to be noted that the apparatus is of the upright or vertical type wherein the shaft 12 extends in a horizontal plane while the apparatus is in operation. In the description given below, the shaft 12 and other shafts described later are referred to as horizontal shafts.

The index table 10 is provided with three horizontal shafts 16, 18 and 20 which are disposed such that the axes thereof lie on a circle the center of which is coincident with the axis of the horizontal shaft 12 and so as to be circumferentially spaced at equal angular intervals. In this embodiment three substrate carriers 22, 24 and 26 are disposed on the index table 10 and arranged to be intermittently rotatable about the horizontal shafts 16, 18, 20, respectively, in the direction indicated by the arrows 28, 30, 32.

A substrate loading and unloading unit 50 for loading and unloading hard disk substrates relative to a main portion 8 (central portion) of the apparatus includes two substrate transfer arms 52 and 54. The arm 52 is reciprocally movable along two parallel spaced horizontal rails 56 to take out one substrate at a time from a substrate stocker (not shown) and supply the same into the main portion 8 of the apparatus. Similarly, the arm 54 is reciprocally movable along two parallel spaced horizontal rails 58 to remove the polished substrates one at a time from the main portion 8 of the apparatus.

In FIG. 1, reference numerals **60*a*, 60*b*, 60*c*, 60*d* and 60*e* designate substrates as they are held by substrate holders 59*a*, 59*b*, 59*c*, 59*d* and 59*e*, respectively, of the substrate carrier 22. Similarly, reference characters 62*a*, 62*b*, 62*c*, 62*d* and 62*e* designate substrates as they are held by substrate holders 61*a*, 61*b*, 61*c*, 61*d* and 61*e*, respectively, of the substrate carrier 24. In addition, reference characters 64*a*, 64*b*, 64*c*, 64*d* and 64*e* designate substrates as they are held by substrate holders 63*a*, 63*b*, 63*c*, 63*d* and 63*e*, respectively, of the substrate carrier 26**.

In FIG. 1 the substrate carriers 22, 24 and 26 are illustrated as being disposed at a substrate mounting station, a substrate polishing station and a substrate removing station, respectively. These stations are defined within the main portion 8 of the apparatus.

In the substrate mounting station, a plurality (five in the illustrated embodiment) of substrates are mounted on the substrate carrier 22. In the substrate polishing station, the substrates mounted on the substrate carrier 24 are polished on their opposite sides, while in the substrate removing station, the substrates which have been polished are removed from the substrate carrier 26. Numeral 66 designates one of a pair of circular polishing pads used for polishing the substrates held on the substrate carrier 24 while it is located in the polishing station. The other polishing pad is not shown in FIG. 1.

Figure 2:
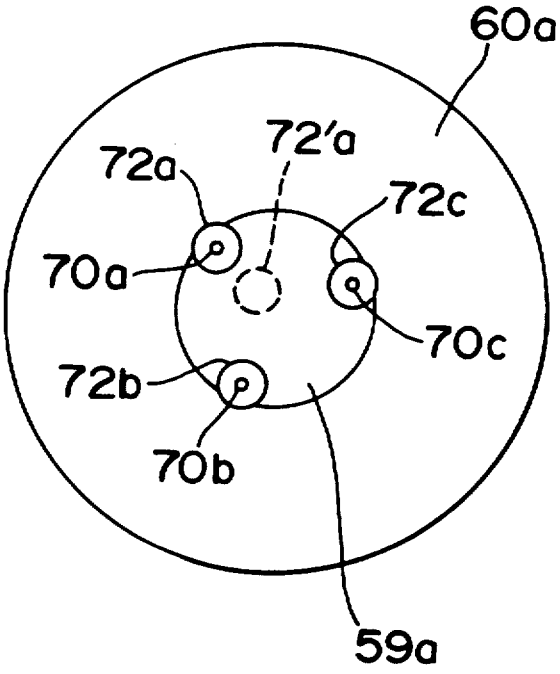
FIG. 2 is an enlarged view of a portion of the apparatus shown in FIG. 1.

FIG. 2 illustrates the manner in which one substrate is mounted on a corresponding one of the substrate holders of the substrate carriers. In this figure the substrate holder is designated by 59a (see FIG. 1) and the substrate is designated by 60a (see FIG. 1). As shown in FIG. 2, the substrate holder 59a includes three support rollers 72a, 72b and 72c which are rotatably mounted on three horizontal support shafts 70a, 70b and 70c, respectively. The support shafts 70a, 70b, 70c are circumferentially spaced at equal angular intervals. The support rollers 72a, 72b, 72c take the form of bobbins, for example, which each have a circumferential groove in which an inner peripheral edge of the substrate is received.

In this arrangement the support shaft 70a is retractable in a radially inward direction from the position illustrated in solid line until the support roller 72a assumes the position illustrated by the shown in broken line and designated by 72a'. This allows the substrate 60a to be readily mounted and removed from the substrate holder. For purposes of illustrative simplicity and in view of the fact it will be familiar to those skilled in the art, the mechanism for displacing the support shaft 70a and hence the support roller 72a is not shown.

The foregoing description given with reference to FIG. 2 relates to the manner of loading of the substrate onto the substrate holder. It is understood that the support roller 72a is displaced from the solid-lined position to the broken-lined position shown in FIG. 2 when the substrate 60a is removed from the main portion 8 of the apparatus.

Figure 3:
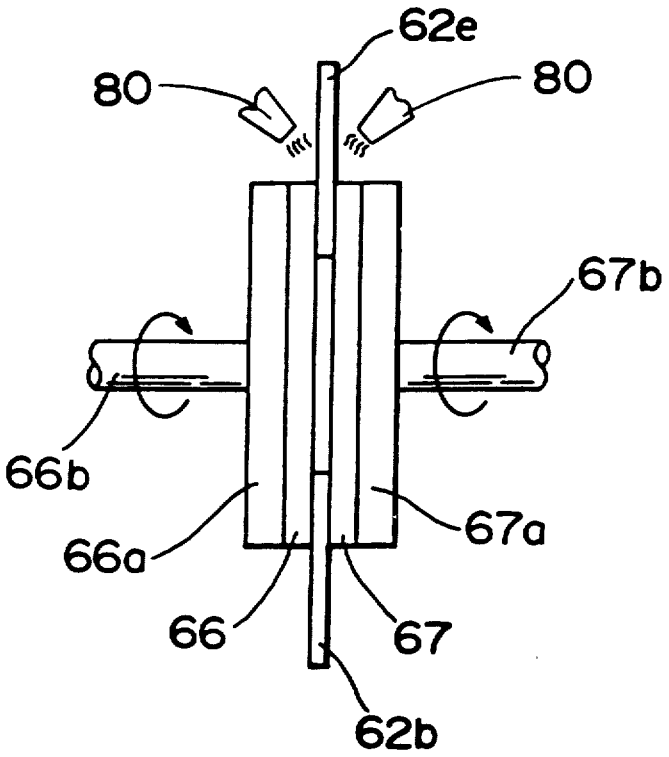
FIG. 3 is a side view of a portion of the apparatus shown in FIG. 1.

FIG. 3 is a side view illustrative of the manner in which plural substrates held on a substrate carrier while in the polishing station, are polished on their opposite sides. In FIG. 3, the polishing pad 66 and the substrates 62b and 62e are the same as those already shown in FIG. 1. The polishing pad 66 is secured to a circular support plate or disk 66afirmly connected to an 10 end of a rotating shaft 66b. A polishing pad 67 which is paired with the polishing pad 66, is secured to a circular support plate or disk 67a firmly connected to an end of a rotating shaft 67b. As described above, each of the substrates held by the support rollers 72a, 72b, 72c is rotatable about its own axis, so that by forcing the pair of polishing pads 66, 67 against opposite sides of the respective substrates 62a, 62b, 62c, 62d and 62e while rotating the polishing pads 66, 67 in a same direction indicated by the arrows in FIG. 3, the substrates are rotated about their own axes. Thus, the substrates 62a–62e are polished simultaneously by the polishing pads 66, 67 on their opposites sides.

Operation of the apparatus of the foregoing construction will be described below with reference to FIGS. 1 through 3.

Assuming that there is no substrate held on the substrate carriers 22, 24, 26 shown in FIG. 1, the arm 52 of the substrate loading and unloading unit 50 operates to take out substrates one at a time from the substrate stocker, not shown, and supply them successively into the main portion 8 of the apparatus. The substrate holder 59a shown in FIG. 1 is disposed in a receiving position in which the substrate holder 59a receives the substrate from the arm 52. After the substrate is supported on the substrate holder 59a, the substrate carrier 22 turns in the direction of the arrow 28 through an angle of 72 degrees (namely, one fifth of 360 degrees). Under these conditions, the next substrate holder 59e is disposed in the receiving position so that it can receive the substrate from the arm 52. Thus all the five substrate holders 59a, 59b, 59c, 59d and 59e of the substrate carrier 22 are successively loaded with substrates. For mounting the substrates on the substrate holders 50a–59e, one of the support rollers of each substrate holder is retracted radially inwardly to accommodate the disposition of a substrate onto the substrate holder in the manner described above with reference to FIG. 2.

When all the substrate holders 59a–59e of the substrate carrier 22 which is currently located in the substrate mounting station are supplied with substrates, the index table 10 turns in the direction of the arrow 14 through an angle of 120 degrees (namely, one third of 360 degrees). With this angular movement of the index table 10, the substrate carrier 22 is moved into the substrate polishing station, and the substrate carrier 26 moved into the substrate mounting station.

The substrate carrier 26, is then loaded with five substrates in the same manner as described above. During this loading period, the substrates 60l–60e held on the substrate carrier 22 and disposed in the polishing station, are polished on their opposite sides by the pair of polishing pads 66, 67 (FIG. 3).

The polishing pads 66, 67 may be rotated in the same direction as shown in FIG. 3, or alternately in opposite directions. In the latter case, the polishing pads 66, 67 are rotated at different speeds for causing the substrates to rotate along with rotation of the pressure pads 66, 67.

After the polishing of the substrates carried on the substrate carrier 22 and the mounting of the substrates on the substrate carrier 26 are performed, the index table 10 is turned again in the direction of the arrow 14 through an angle of 120 degrees. This moves the substrate carriers 22, 26 and 24 into the substrate removing station, substrate polishing station and substrate mounting station, respectively.

At the substrate removing station, the polished substrates are removed one by one from the substrate carrier 22 by means of the arm 54 in timed relation to intermittent rotation of the substrate carrier 22. During this operation time, the substrate carrier 24 which has been moved into the substrate mounting station is supplied with five substrates, and the substrates supported on the substrate carrier 26 located at the substrate polishing station, are polished.

The shafts 66b and 67b are supported by ball bearings, and the polishing pads 66, 67 are supplied with a suitable slurry of grinding/polishing media.

As described above, since the hard disk substrate polishing apparatus of this invention is of the vertical type, the opposite sides of each substrate can be polished under substantially the same polishing conditions. Consequently, the opposite sides of the substrate are polished evenly and hence have substantially the same finishing quality. In addition, as appears clear from FIG. 1, the diameter of the polishing pads (one being shown) is small. This ensures that the polishing pads engage the substrates uniformly over the entire area thereof Thus, the substrates can be polished with high accuracy without causing any problems such as sagging The hard disk substrate polishing apparatus may further comprise means 80 which is arranged in the polishing station for washing the polished substrates and subsequently drying them, as shown in FIG. 3. The washing and drying means 80 is operative in timed relation to the operation of the polishing pads 66, 67 such that operation of the washing and drying means 80 begins when the polishing pads 66, 67 are retracted by a suitable distance from the substrate surfaces after polishing of the substrates is performed. In the illustrated embodiment, the number of the substrate carrier is three. As will be appreciated this number is merely illustrative, and four or more substrate carriers may be used.

As will be clear from the foregoing description, the gist of this invention resides in the construction of the main portion 8 of the apparatus. The loading and unloading unit 50 for loading and unloading substrates relative to the main portion 8 of the apparatus is not limited to the illustrated mechanism and various substrate loading and unloading units can be employed.

As described above, the apparatus of this invention is able to continuously polish (and subsequently wash and dry) batches of substrates. Further, the apparatus is of the vertical type so that the substrates can be polished with a high degree of accuracy. Furthermore, only a small space is needed for installation of such a vertical type apparatus.

Obviously, various minor changes and modifications of the present invention are possible in the light of the above teaching. It is therefore to be understood that within the scope of the appended claims the invention may be practiced otherwise than as specifically described.

What is claimed is:

1. An apparatus for polishing hard disk substrates, comprising:

an index table intermittently rotatable about a first axis; and at least three substrate carriers each rotatably supported on the index table so as to be rotatable about a second axis, each of said substrate carriers being so constructed and arranged as to support a plurality of hard disk substrates, said index table being rotatable to move said substrate carriers successively through a substrate mounting station in which a plurality of hard disk substrates are mounted on said substrate carriers, a substrate polishing station in which a plurality of hard disk substrates supported on said substrate carriers are polished, and a substrate removing station in which a plurality of polished hard disk substrates are removed from said substrate carriers 2. An apparatus according to claim 1, further including loading means for supplying a plurality of hard disk substrates to a substrate carrier which is disposed in said mounting station, polishing means for polishing opposite sides of each of the hard disk substrates supported on a substrate carrier which is disposed in said substrate polishing station, and unloading means for removing the polished hard disk substrates from a substrate carrier which is located in said substrate removing station 3. An apparatus according to claim 1, further including means disposed in said polishing station for washing and drying the hard disk substrates supported on a substrate carrier disposed in said polishing station after the hard disk substrates are polished 4. An apparatus according to claim 2, further including means disposed in said polishing station for washing and drying the hard disk substrates supported on a substrate carrier which is located in said polishing station after said polishing means completes polishing of the hard disk substrates.

5. An apparatus according to claim 1, wherein said first and second axes are horizontal while said apparatus is in operation 6. An apparatus according to claim 2, wherein said substrate carriers are intermittently rotatable and each includes a plurality of substrate holders circumferentially spaced at equal angular intervals about said second axis, said loading means is operative in timed relation to intermittent rotation of said substrate carriers so as to supply the hard disk substrates one at a time to the substrate holders of each of said substrate carriers, and said unloading means is operative in timed relation to intermittent rotation of said substrate carriers so as to remove the polished hard disk substrates one at a time form said substrate holders of each of said substrate carriers.

* * * * *